US008087969B2

(12) United States Patent
Sun et al.

(10) Patent No.: US 8,087,969 B2
(45) Date of Patent: Jan. 3, 2012

(54) COSTUME APPARATUS

(75) Inventors: Steed Sun, San Gabriel, CA (US); Binh Luong, Kowloon (HK); Brandon C. Sopinsky, Redondo Beach, CA (US); Peter Fan, Torrance, CA (US); Michael L. Strauss, Signal Hill, CA (US)

(73) Assignee: Mattel, Inc., El Segundo, CA (US)

( * ) Notice: Subject to any disclaimer, the term of this patent is extended or adjusted under 35 U.S.C. 154(b) by 292 days.

(21) Appl. No.: 12/210,999

(22) Filed: Sep. 15, 2008

(65) Prior Publication Data

US 2009/0075550 A1 Mar. 19, 2009

Related U.S. Application Data

(60) Provisional application No. 60/972,795, filed on Sep. 15, 2007.

(51) Int. Cl.
*A63H 33/00* (2006.01)

(52) U.S. Cl. ..... 446/28; 446/26

(58) Field of Classification Search ..... 446/26, 446/28; 472/70; 244/22, 28, 72, 151 R, 244/155 R See application file for complete search history.

(56) References Cited

U.S. PATENT DOCUMENTS 766,613 A 8/1904 Greene
1,324,218 A * 12/1919 Ward ..... 472/70
1,485,163 A * 2/1924 Braun ..... 244/35 R
2,018,062 A * 10/1935 Hardt ..... 280/810
D175,789 S 10/1955 Massey
2,783,955 A * 3/1957 Fitz Patrick ..... 244/22
2,810,576 A 10/1957 Massey
2,810,985 A 10/1957 Bilder
4,411,398 A * 10/1983 Wedertz et al. ..... 244/3.28
5,713,603 A * 2/1998 Carter ..... 280/810
5,742,939 A 4/1998 Williams
6,041,436 A 3/2000 Keen
6,099,041 A * 8/2000 Carter ..... 280/810
D433,210 S 11/2000 Allison
6,234,530 B1 * 5/2001 Carter ..... 280/810
6,536,049 B2 * 3/2003 Jastrab et al. ..... 2/88
D494,743 S 8/2004 Bourget
7,037,163 B2 * 5/2006 Beard ..... 446/28
D527,171 S 8/2006 Frederick
7,175,496 B1 * 2/2007 Lund et al. ..... 446/28
7,380,285 B1 * 6/2008 Moreno ..... 2/69
2003/0197090 A1 * 10/2003 Klima ..... 244/4 A

* cited by examiner

*Primary Examiner* — Gene Kim
*Assistant Examiner* — Alyssa Hylinski
(74) *Attorney, Agent, or Firm* — The Mueller Law Office, P.C.

(57) ABSTRACT

This invention refers to a costume apparatus for enabling a user to engage in role play activities or action play adventures. The costume apparatus may be mounted on a user's back, and comprises deployable arm assemblies which are controlled by a pull cord system. In one embodiment, the costume apparatus takes the form of expandable wings. The arm assembly of the costume apparatus may include two arm pieces connected by a pivoting joint, and may further include a hinged joint within one of the arm pieces. The hinged joint provides a safety feature for the deployed costume apparatus by allowing the arm assemblies to fold rearward when obstacles are encountered.

7 Claims, 6 Drawing Sheets

COSTUME APPARATUS

RELATED APPLICATIONS

This application claims priority to U.S. Provisional Patent Application Ser. No. 60/972,795 filed on Sep. 15, 2007 entitled "Costume Apparatus," which is hereby incorporated by reference as if set forth in full in this application for all purposes.

BACKGROUND OF THE INVENTION

Winged costumes are used in many situations such as stage productions, holiday events, and children's role playing activities. Over the years, these costumes have utilized a variety of features to improve their appearance and functionality. In one aspect, the ease of putting on or removing a winged costume has been addressed with detachable pads, shoulder and wrist straps, and harnesses. In other aspects, wings have been made to be collapsible using inflatable components, overlapping plates, or fabric mounted on pivoting rods. Flapping motion for wings has been provided by electrical motors, air bellows, and mechanical systems incorporating levers and springs. Unique ways of devising these features as well as other novel elements for winged costumes can result in improved amusement value and increased functionality for a user.

SUMMARY OF THE INVENTION

This invention refers to a costume apparatus for enabling a user to engage in role play activities or action play adventures. The costume apparatus may be mounted on a user's back, and comprises deployable arm assemblies which are controlled by a pull cord system. In one embodiment, the costume apparatus takes the form of expandable wings. The arm assembly may include two arm pieces connected by a pivoting joint, and may further include a hinged joint within one of the arm pieces. The hinged joint provides a safety feature for the deployed costume apparatus by allowing the arm assemblies to fold rearward when obstacles are encountered. Alternatively, the hinge joint may instead be a rotating joint which allows the user to alter the orientation of the wings. The costume apparatus of this invention sets forth winged configurations and features not described previously in the art, thus providing a user with new opportunities for creative play.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE EMBODIMENTS

Embodiments according to the present invention shall now be described in more detail in reference to the accompanying figures. In this disclosure, a "housing" shall be described as a backpack configuration but may also refer to other types of carriers such as a bag or a hard case. The term "pull cords" is described as cords used to actuate a costume apparatus, but may also refer to wires, fabric straps, plastic tubing, or the like. Similarly, reference to shoulder and waist straps may imply other means for enabling a user to wear a costume apparatus such as harnesses or vests. Although the cape described in this disclosure is illustrated in the shape of bat wings, other shapes are possible such as angel wings, bird wings, and airplane wings.

Figure 1:
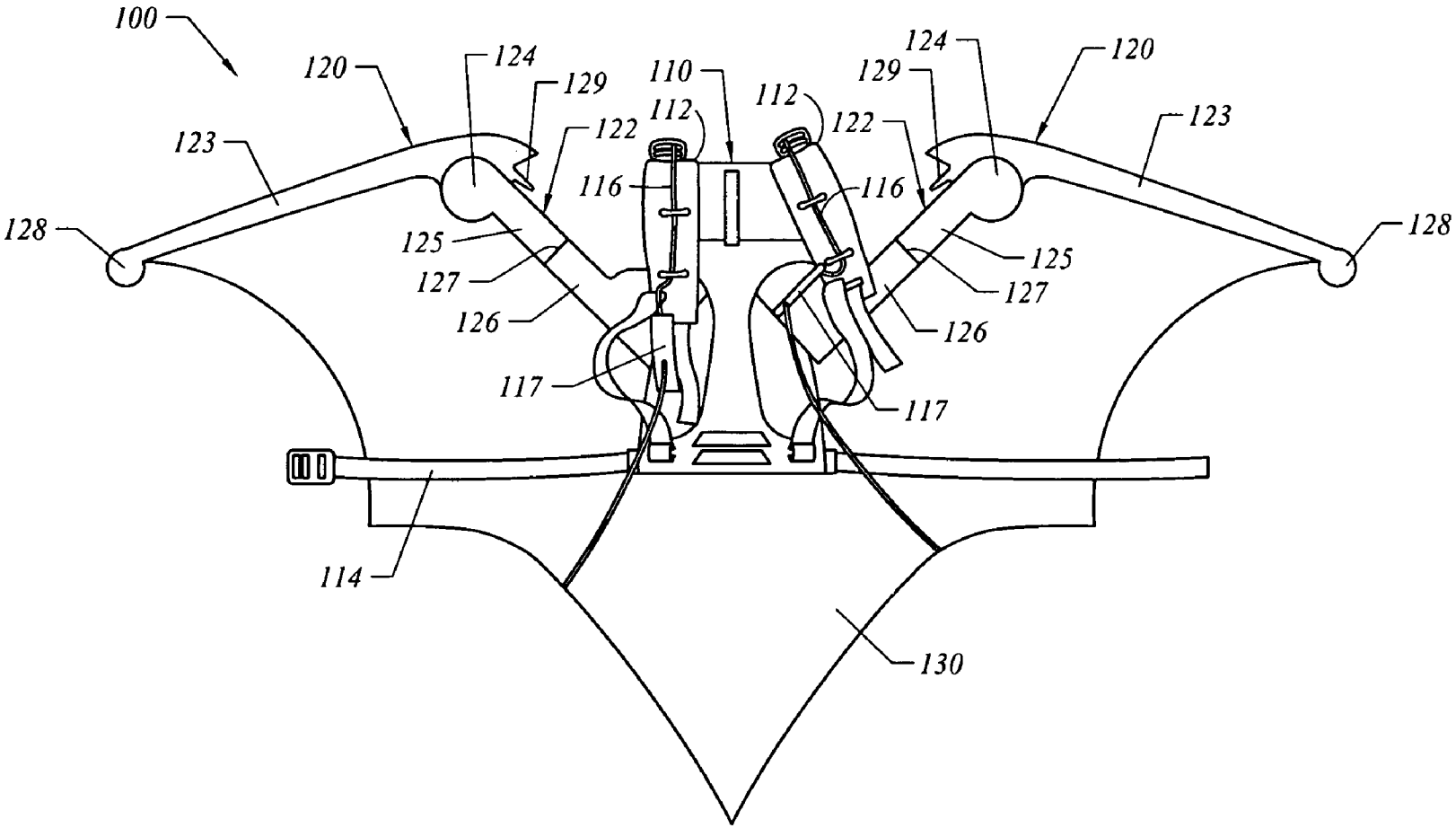
FIG. 1 provides a front view of an assembled embodiment of a deployed costume apparatus according to the present invention.

FIG. 1 provides a front view of an assembled embodiment of a costume apparatus 100. In this figure, a housing 110 includes two shoulder straps 112, a waist strap 114, and pull cords 116 with cord handles 117 along each shoulder strap 112. Two arm assemblies 120 are coupled to each side of housing 110. Arm assemblies 120 each comprise a main arm 122 and an outer arm 123 pivotally joined at an elbow joint 124. Main arms 122 each include an upper main arm 125 and a lower main arm 126 which meet at a joint 127. Tips 128 of outer arms 123 may be covered with a padded material such as foam. Hooks 129 near each elbow joint 124 latch into the top of housing 110 to secure the arm assemblies 120 in a folded configuration. Alternatively, hooks 129 may be incorporated onto housing 110. A wing material 130 hangs from arm assemblies 120 and across housing 110.

Figure 3:
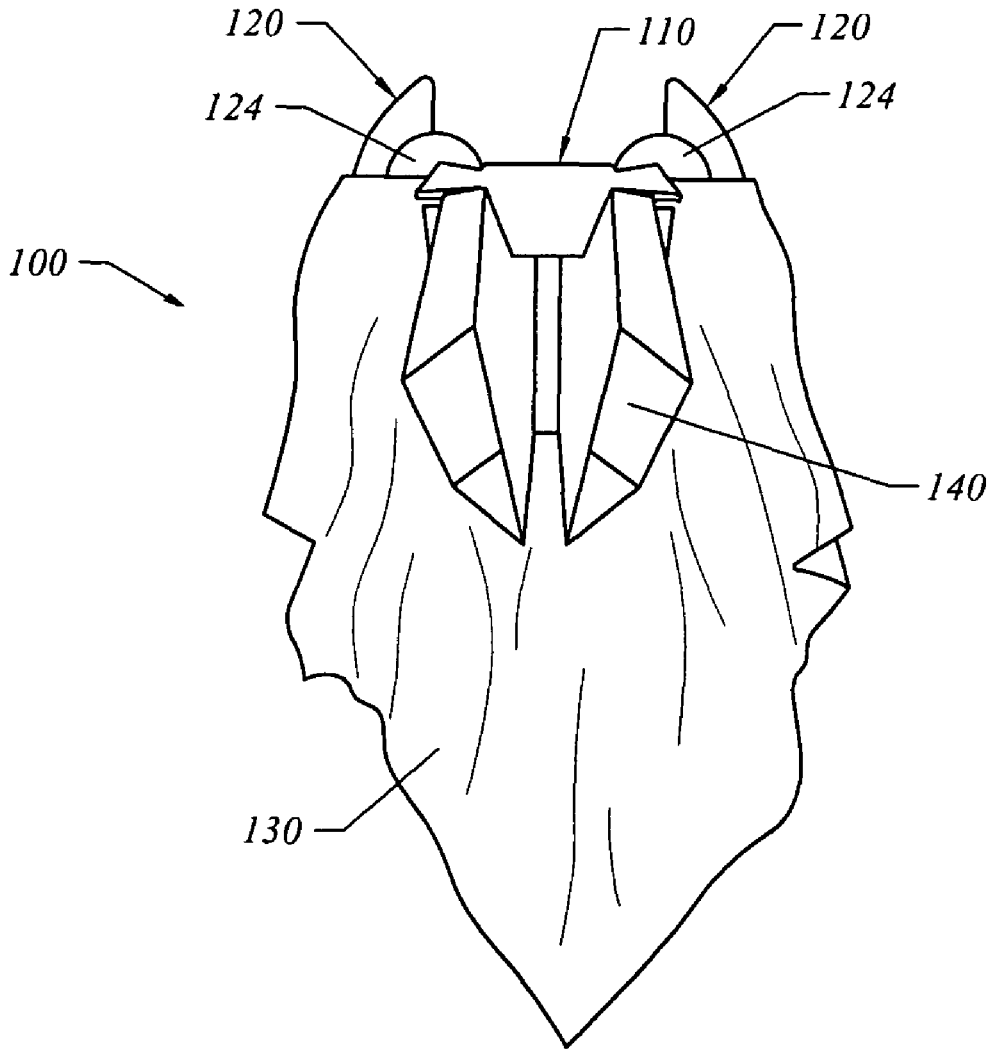
FIG. 3 depicts a rear view of the costume apparatus of FIG. 1 with arms folded.

In the embodiment of FIG. 1, housing 110 is configured as a backpack. Alternatively, housing 110 may take other forms such as a bag or other type of carrier which is capable of housing mechanical components associated with deployment of the arm assemblies 120 and which is amenable to being worn as a costume by the user. Housing 110 is hung on a user's shoulders with shoulder straps 112, and may be additionally supported on the user's body with waist strap 114. Pull cords 116, which are mechanically coupled to a deployment system within the interior of housing 110, are tethered along the front of shoulder straps 112 such that cord handles 117 may be accessed by the user. When cord handles 117 are pulled downward by the user, pull cords 116 toggle the arm assemblies 120 between an expanded or open position, as shown in FIG. 1, and a closed position as shown in FIG. 3. Note that while two pull cords 116 are embodied in FIG. 1, a single pull cord or more than two are also possible. In another embodiment, one set of cords may control the opening of the arm assemblies 120 while another set of cords may be used to close the arm assemblies 120.

The joints 127 located along the length of main arms 122 provide unique play features to the costume apparatus 100. In one embodiment, joints 127 are hinged to enhance safety to the user and the costume apparatus 100 while the arm assemblies 120 are deployed. Because of the wide wingspan of costume apparatus 100, arm assemblies 120 may collide with structures encountered during play. Hinged joints 127 allow arm assemblies 120 to fold, typically rearward, when an obstacle is encountered, thus decreasing potential damage to the arm assemblies 120. The positioning of joints 127 may be chosen based on the desired span at which a user may safely pass through obstacles, such as a doorway, with the arm assemblies 120 open. In one embodiment, joints 127 may include a torsion spring in addition to a hinge such that upper main arms 125 rebound back in alignment with lower main arms 126 when arm assemblies 120 are no longer in contact with the obstacle. Alternatively, a torsion spring may be omitted from joint 127 such that upper main arms 125 may be manually straightened by the user.

In another embodiment, joints 127 may be configured as a pin joint or other type of rotational joint. For instance, a pin oriented parallel to the axis of main arm 122 allows upper main arm 125 to rotate, that is, twist, around the axis of the pin. Consequently, outer arm 128 is also rotated and is reoriented from extending laterally outward from the user to pointing rearward from the user. Such a rotating joint offers the user creative play scenarios not possible without the intermediate joints 127.

Figure 2:
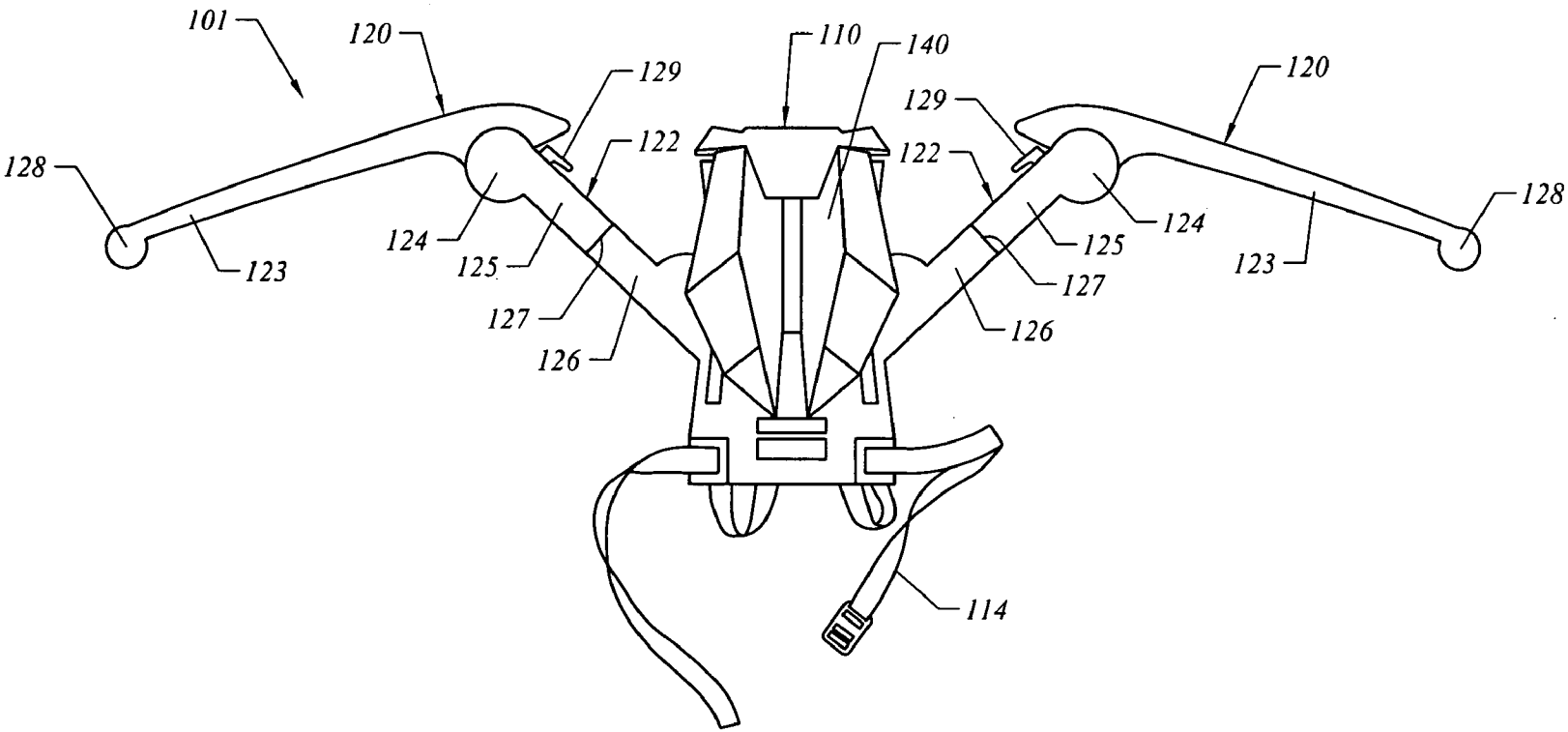
FIG. 2 shows a rear view of the underlying structure of the costume apparatus of FIG. 1.

FIG. 2 provides a rear view of a costume apparatus 101 in a deployed position. Costume apparatus 101 is identical to the costume apparatus 100 of FIG. 1, although without the wing material 130 attached so that the arm assemblies 120 may be seen more clearly. The same components related to housing 110 and arm assemblies 120 as previously described in FIG. 1 are similarly viewed here in FIG. 2. Additionally, a decorative panel 140 attached to housing 110 is seen in this rear view.

FIG. 3 shows a rear view of the costume apparatus 100 from FIG. 1, now with arm assemblies 120 in a folded position. In this folded position, only the elbow joints 124 of arm assemblies 120 are visible. Wing material 130 covers the folded arm assemblies 120, as well as the majority of housing 110. Panel 140 is layered over wing material 130 to provide aesthetic value as well as to assist in keeping wing material 130 secured to housing 110.

Figure 4:
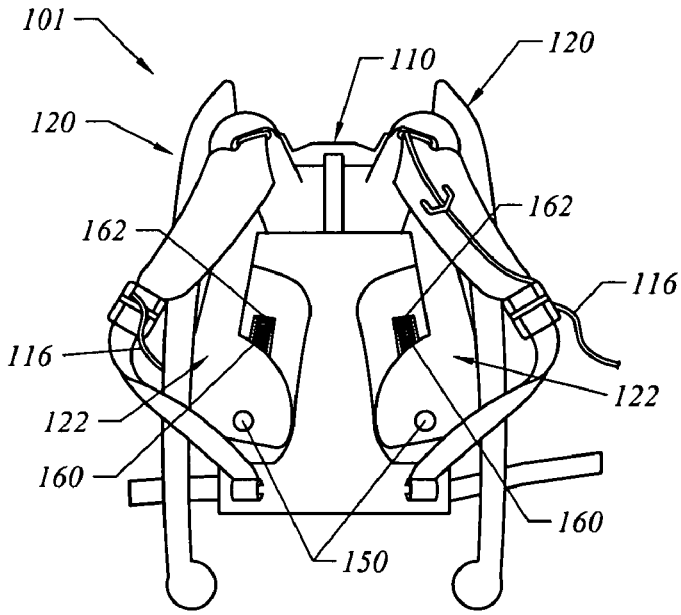
FIG. 4 gives a front view of the costume apparatus structure of FIG. 2 with arms folded.
Figure 5:
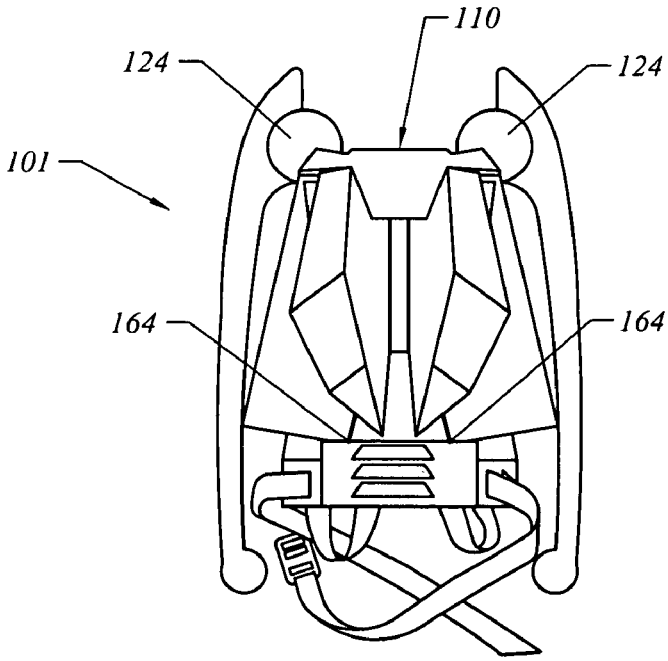
FIG. 5 is a rear view of the costume apparatus structure of FIG. 4.

Further details of the underlying components of the costume apparatus 101 of FIG. 2 will now be discussed. FIGS. 4 and 5 show front and rear views, respectively, of costume apparatus 101 with arm assemblies 120 in their folded positions. Housing 110 is shown without ergonomic covering or padding so that its mechanical structure can be seen. In FIG. 4, joints 150, compression springs 160, and slots 162 are visible near the lower sides of housing 110. Main arms 122 are pivotally coupled to housing 110 at joints 150, which are pin joints in this embodiment. Compression springs 160, seen within slots 162, are coupled to joints 150 and remain at their natural length when arm assemblies 120 are folded. Pull cords 116, with cord ends 164 fixedly attached to housing 110 as shown in FIG. 5, traverse a pulley system, not shown, within housing 110. When the user pulls the pull cords 116, the pull cords 116 lift joints 150 upward along slots 162, causing compression springs 160 to compress. Compression springs 160 are locked in a fully compressed position using a pulley clutch or other latching mechanisms known in the art coupled to compression springs 160. As main arms 122 are lifted, the previously described hooks 129 are unlatched from housing 110, and main arms 122 pivot outwardly from housing 110. Main arms 122 may naturally pivot outward due to gravity or may be assisted by a spring. Outer arms 123 are caused to pivot outwardly in conjunction with the pivoting movement of main arms 122 by mechanisms housed within elbow joints 124. The mechanisms within elbow joints 124 may comprise levers, springs, elastic bands, or other components known in the art. Furthermore, the compression springs 160 may be augmented or replaced by gears, levers, or other mechanical assemblies known in the art.

To retract arm assemblies 120 from their deployed positions in the embodiment of FIGS. 4 and 5, the user pulls the pull cords 116 again. This action releases the latching mechanisms which are coupled to compression springs 160, thus unlocking compression springs 160 from their compressed state. The released compression springs 160 push downward on joints 150, causing them to slide downward in slots 162. Consequently, main arms 122 and outer arms 123 are pivoted back into their closed positions. In other embodiments, arm assemblies 120 may be manually closed, or a separate pull cord may be used to retract arm assemblies 120. Retraction of arm assemblies 120 with one or more pull cords may encompass, for example, a pulling action in a single stroke, or multiple pulls in a ratcheting action.

Figure 6A:
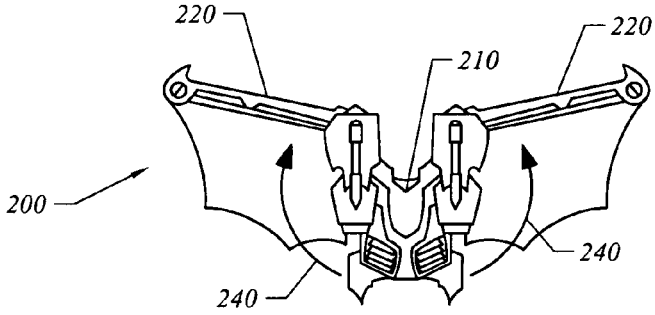
FIGS. 6A and 6B illustrate another embodiment according to the present invention.
Figure 6B:
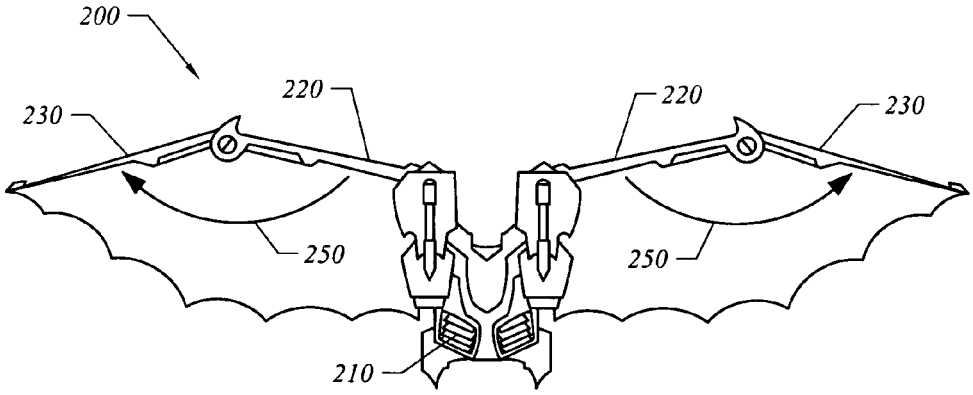

Other variations of the costume apparatus of this invention are possible. For example, FIGS. 6A and 6B illustrate a costume apparatus 200 with a two-step expansion process as opposed to a simultaneous deployment of an entire arm assembly as described with costume apparatus 100. Costume apparatus 200 includes a housing 210, main arms 220, and outer arms 230 pivotally attached to main arms 220. In FIG. 6A, a first activation step causes the main arms 220 to open as indicated by arrows 240. A second activation step in FIG. 6B subsequently extends two outer arms 230, as indicated by arrows 250. Note that in this embodiment with costume apparatus 200, the main arms 220 pivot from the top of housing 210 rather than near the bottom as was the case for costume apparatus 100. In one embodiment, the two-step expansion may be achieved by utilizing two sets of pull cords, one cord for controlling actuation of main arms 220 and the other cord for controlling actuation of the outer arms 230. In another embodiment, a locking mechanism—including but not limited to a hook, a latch, or a spring—may be incorporated into the arm assemblies. The locking mechanism keeps outer arm 230 folded against main arm 220 and is disabled only when main arms 220 are open. Thus, a locking mechanism can be used to insure expansion of outer arms 230 only after main arms 220 have been opened. In either of these embodiments, a first pull of a pull cord may open the main arms 220, while a second pull of a pull cord may deploy the outer arms 230. Additional configurations for implementing a two-step expansion are possible, and are not limited to the examples described herein.

Figure 7A:
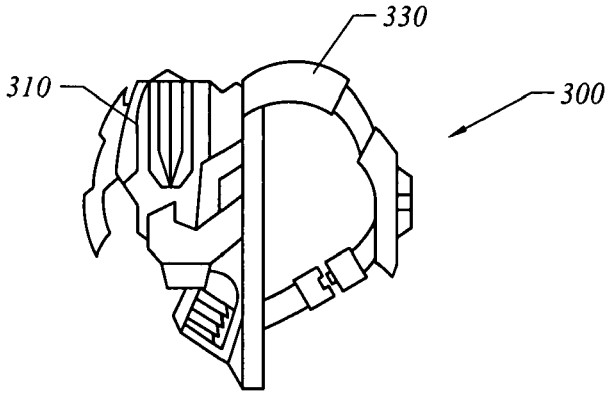
FIGS. 7A, 7B, and 7C depict a further embodiment according to the present invention, in which a costume apparatus is mounted with a projectile launcher.
Figure 7B:
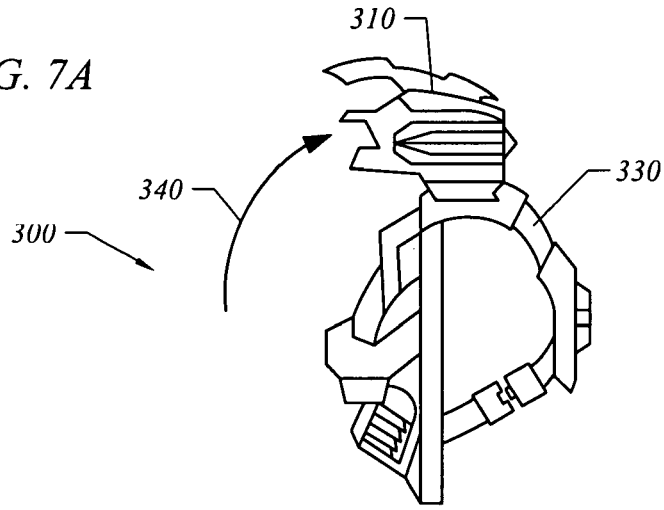
Figure 7C:
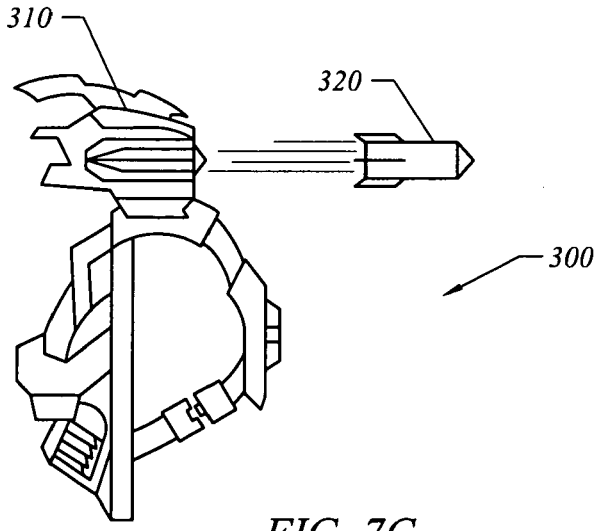

In the side views of FIGS. 7A, 7B, and 7C, a further embodiment according to the present invention is shown. In FIGS. 7A, 7B, and 7C, a costume apparatus 300 has a projectile launcher 310 mounted on a shoulder strap 330 for releasing a projectile 320. Projectile launcher 310 may slide along shoulder strap 330 from a stored position in FIG. 7A to a launching position as indicated by arrow 340 shown in FIG. 7B. Expandable arm assemblies, not shown in these side views, for costume apparatus 300 may be deployed with the launcher 310 in either the stored or launching position.

Other variations of the invention are yet possible. As one example, the housing, which has been described in this disclosure as a backpack, may instead be configured as a vest or may be secured to the user's torso with horizontal straps around the chest. Instead of pulling on the pull cords to deploy the arm assemblies, the pull cords may be reeled in and out with a rotary wheel. In another variation, the invention may comprise a single arm assembly expanding perpendicularly from the user's back rather than two arm assemblies expanding laterally. This perpendicular arm assembly may simulate, for instance, a blade along the spine of a dragon costume. Furthermore, the hinge joint which has been described within the main arm may instead be located within the outer arm.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the spirit and scope of the present invention, which is more particularly set forth in the appended claims. Furthermore, those of ordinary skill in the art will appreciate that the foregoing description is by way of example only, and is not intended to limit the invention. Thus, it is intended that the present subject matter covers such modifications and variations as come within the scope of the appended claims and their equivalents.

What is claimed is:

1. A costume apparatus, comprising:

a housing;

a main arm having a first end and a second end, wherein the first end of the main arm is pivotally coupled to the housing, and wherein the main arm has a closed position and an open position;

an outer arm having a base, wherein the base of the outer arm is pivotally coupled to the second end of the main arm;

a hinge joint between the first end and the second end of the main arm, wherein the hinge joint is hinged in a direction to move the outer arm rearward relative to the housing; and a cord, wherein the cord controls actuation of the main arm between the closed position and the open position.

2. The costume apparatus of claim 1, wherein the main arm and the outer arm comprise an arm assembly, and wherein two arm assemblies are pivotally coupled to the housing, and wherein the hinge joint of each arm assembly moves the outer arm from extending laterally outward from the housing to rearward of the housing.

3. The costume apparatus of claim 2, further comprising two cords, wherein each of the cords controls each of the arm assemblies.

4. The costume apparatus of claim 2, further comprising a wing material coupled to the two arm assemblies.

5. The costume apparatus of claim 1, wherein the cord is configured to actuate both the main arm and the outer arm when the cord is pulled.

6. A costume apparatus, comprising:

a housing;

a main arm having a first end and a second end, wherein the first end of the main arm is pivotally coupled to the housing, and wherein the main arm has a closed position and an open position;

an outer arm having a base, wherein the base of the outer arm is pivotally coupled to the second end of the main arm; and a cord, wherein the cord controls actuation of the main arm between the closed position and the open position;

wherein the cord is configured to actuate the main arm to the open position when the cord is pulled a first time, and wherein the cord is configured to actuate the outer arm to an outwardly pivoted position when the pull of the cord is repeated a second time.

7. The costume apparatus of claim 6, wherein the main arm comprises a rotational joint, and wherein the rotational joint rotates the outer arm rearward relative to the housing.

* * * * *